US006526589B1

(12) United States Patent
Jeziak et al.

(10) Patent No.: US 6,526,589 B1
(45) **Date of Patent: *Mar. 4, 2003**

(54) TATTOOED TEAR WEAR

(76) Inventors: Michael C. Jeziak, 29323 Gratiot Ave., Roseville, MI (US) 48066; John A. Motyka, 29323 Gratiot Ave., Roseville, MI (US) 48066

( * ) Notice: Subject to any disclaimer, the term of this patent is extended or adjusted under 35 U.S.C. 154(b) by 0 days.

This patent is subject to a terminal disclaimer.

(21) Appl. No.: 10/041,424

(22) Filed: Jan. 8, 2002

Related U.S. Application Data

(63) Continuation-in-part of application No. 09/978,405, filed on Oct. 16, 2001.

(51) Int. Cl.[7] ..... A41B 1/00
(52) U.S. Cl. ..... 2/69; 2/115; 2/227
(58) Field of Search ..... 2/115, 227, 228, 2/238, 69.85, 108, 83, 93, 95, 80, 105, 106, 400–408, DIG. 1, 246, 244, 171, 243.1; 40/586

(56) References Cited

U.S. PATENT DOCUMENTS 4,813,081 A * 3/1989 Cliff et al. ..... 2/115
5,175,888 A * 1/1993 Clark ..... 2/243.1
5,347,658 A * 9/1994 Clark ..... 2/69
5,515,542 A * 5/1996 Simmons ..... 2/67
5,617,586 A * 4/1997 Pe Queen et al. ..... 2/239
5,942,065 A * 8/1999 Biggs et al. ..... 156/90
5,951,057 A * 9/1999 Spector ..... 2/246 X
5,958,560 A * 9/1999 Ewan ..... 428/201
5,960,476 A * 10/1999 Danzy ..... 2/115
6,042,881 A * 3/2000 Ewan ..... 427/152
6,044,492 A * 4/2000 Krogh ..... 2/115
6,125,472 A * 10/2000 Nakagawa ..... 2/115

* cited by examiner

*Primary Examiner*—Gloria M. Hale
(74) *Attorney, Agent, or Firm*—Dobrusin & Thennisch P.C.

(57) ABSTRACT

The patch of the present invention provides a method for creating the illusion of an apparel wearer or other substrate, such as a vehicle or advertising medium of having a body tattoo. The patch has a top layer of material that includes a tattoo design surrounded by a bottom layer having a skin-toned or substrate matching colored background. The patch may be purchased with a pre-selected tattoo design permanently affixed to the background or removably fastened for replacement with a new tattoo design. The patch may also include material surrounding the skin-toned or substrate matching colored background. The surrounding material has a torn edge along the perimeter mating with the top layer to give the appearance of a tear within the material.

20 Claims, 2 Drawing Sheets

TATTOOED TEAR WEAR

CROSS-REFERENCE TO RELATED APPLICATIONS

This application is a continuation-in-part of U.S. application Ser. No. 09/978,405 filed on Oct. 16, 2001.

TECHNICAL FIELD

The present invention provides a method and a patch for creating a simulated tattoo on an article of apparel thereby creating the illusion of the wearer having a body tattoo. In addition, it is contemplated that the simulated tattoo of the present invention can be applied to portions of an automotive vehicle or other modes of transportation such as a bus, train, subway car, recreational vehicle, boat, jet ski, and snowmobile using any acceptable method such as adhesive or vinyl graphic technology. Still other methods of application include product packaging for goods such as CD's, DVD's and the corresponding cases and advertising for billboards, placards, mailings and magazine tear-out postcards.

BACKGROUND OF THE INVENTION

Many people enjoy expressing themselves through fashion and body art. In recent years, body art has been used by a wide range of individuals as a means to express their creativity or otherwise create and display an individual lifestyle or fashion statement. These expressions may come in the form of clothing, hair, body piercing and tattoos. Examples of such expressions are torn jeans, dyed hair and tongue piercing. Other expressions are more permanent and may consist of permanent artistic displays to the person's skin. There may come a time when a person may want to change, update or alter these individual expressions only to find out that it is impossible or physically painful to do so. This is particularly true of body piercing and tattoos.

The present invention provides a safe and temporary solution for expressing one's individuality by providing a method and a patch for creating a simulated tattoo on an article of apparel or other product form.

SUMMARY OF THE INVENTION

The patch of the present invention provides a method for creating the illusion of the apparel wearer of having a body tattoo. More specifically, the patch has a top layer of material that includes a tattoo design surrounded by a skin-toned background. The patch may be purchased with a preselected tattoo design permanently affixed to the background. Alternately, a kit including various removable tattoo designs allows the apparel wearer to removably fasten the chosen tattoo design to the skin-toned background by any means such as heat-activated adhesive glue, Velcro, adhesive, heat bonding, zip-on, sewing, or the like.

The patch may also include material surrounding the skin-toned background. The surrounding material preferably is identical to or fashionably matches the material of the body of the apparel to which the patch is to be applied (i.e., the apparel may be in any form such as a T-shirt, pants such as jeans or slacks, a jacket, headband, or a vest, for example and the patch matches the material from which the apparel is formed.) The surrounding material has a torn edge along the perimeter mating with the top layer to give the appearance of a tear within the material. The skin-toned background is a different color than the surrounding material and is preferably the same or similar color of the wearer's skin tone to give the illusion that the torn area is revealing the wearer's skin. Alternatively, the apparel itself may be torn and the resulting opening fringed. The simulated tattoo is fastened to the apparel beneath the apparel opening to reveal the tattoo design. With both embodiments, the patch may be permanently affixed or removably fastened to the apparel by any means such as heat-activated adhesive glue, Velcro, adhesive, heat bonding, zip-on, sewing, or the like.

The resulting apparel gives the illusion that the wearer is wearing torn clothing exposing a tattoo on the wearer's skin in the area of the tear. This illusion allows the wearer to choose and interchange a body tattoo and the location of a tear exposing the tattoo without having to expose the wearer's skin or permanently tattooing the wearer's body.

Additionally, the method of creating a simulated tattoo may be employed to create a patch for product advertising. It is contemplated that the simulated tattoo of the present invention can be applied to portions of an automotive vehicle or other modes of transportation such as a bus, train, subway car, recreational vehicle, boat, jet ski, and snowmobile using any acceptable method such as adhesive or vinyl graphic technology. Still other methods of application include product packaging for goods such as CD's, DVD's and cases and advertising for billboards, placards, mailings and magazine tear-out postcards.

These and other objects of the present invention will become apparent upon reading the following detailed description in combination with the accompanying drawings, which depict systems and components that can be used alone or in combination with each other in accordance with the present invention.

DESCRIPTION OF THE PREFERRED EMBODIMENT

Figure 1:
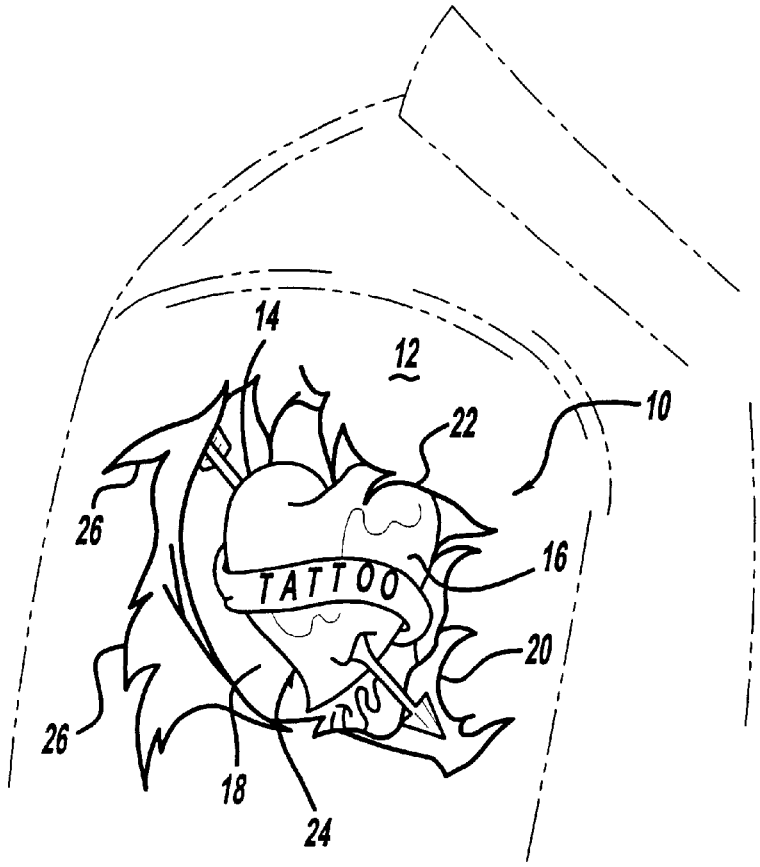
FIG. 1 is a perspective view illustrating a preferred embodiment of the present invention.

With reference to FIG. 1, a patch 10 of the present invention is there shown attached to an article of apparel 12. The patch 10 has a top layer 14 including a tattoo design 16 surrounded by an opposing bottom layer 18. The bottom layer of material 18 is a different color than the tattoo design 16 and article of apparel 12 and is preferably the same color as or as closely matching to the wearer's skin tone to give the illusion that the opening 20 is revealing the wearer's skin. The patch 10 may be permanently or removably attached to the perimeter 22 of the opening 20 by any means such as sewing, heat-activated adhesive glue, Velcro, zipper or the like. A tattoo design 16 is chosen by the wearer and added to the bottom layer of material 18. The tattoo design 16 may be a permanent addition to the bottom layer or may be removably attached along its periphery 24 to the bottom layer of material 18 by an means such as heat-activated adhesive glue, Velcro, adhesive, heat bonding, zip-on, sewing, or the like.

In this embodiment, an opening 20 is created within the article of apparel 12 preferably by tearing to form fringing 26 around the perimeter 22 to give the appearance of a tear within the body of the apparel 12. The patch 10 is exposed through the opening 20.

Figure 2:
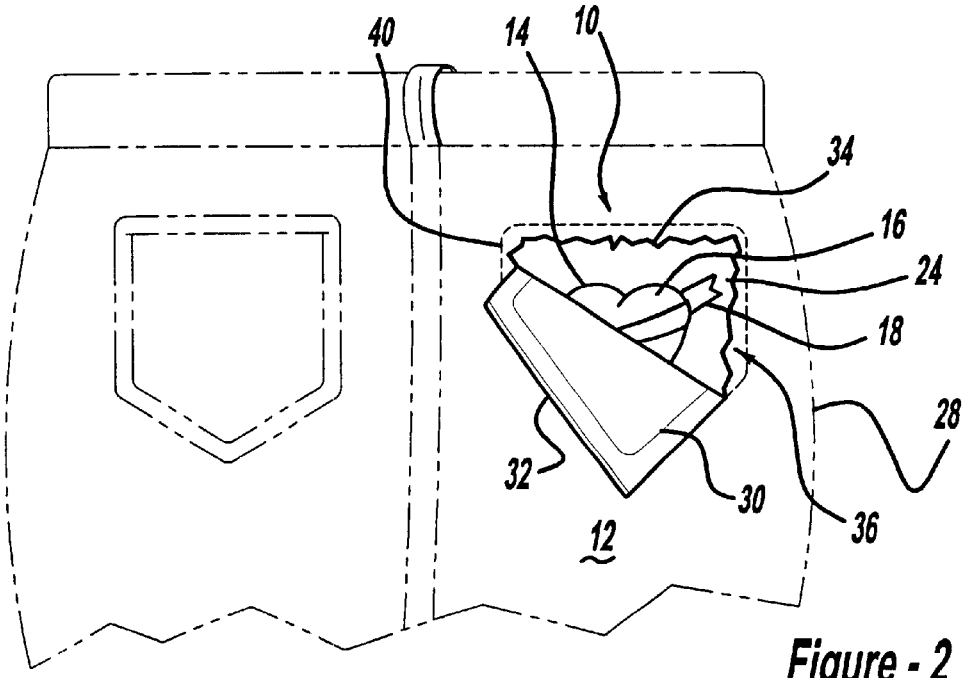
FIG. 2 is a perspective view illustrating a second embodiment of the present invention.

FIG. 2 illustrates an alternative embodiment of the patch 10 wherein the patch includes the additional material forming the tear area surrounding the simulated tattoo of the present invention. A portion of a pair of pants 28 are there shown with the patch 10 forming at least a portion of a back pocket 30. The patch 10 includes a top layer of material 14 having a tattoo design 16 and opposing bottom layer 18. As in FIG. 1, bottom layer 18 is preferably a different color than the tattoo design 16 and article of apparel 12 and is preferably the same color as or as closely matching to the wearer's skin tone. Additional material 32 surrounds the top and bottom layers 14,18 and includes a torn edge 34. The torn edge 34 is preferably along the top layer 14, adjacent the skin-toned bottom layer 18 and simulates a tear within the article of apparel 12. Fringed edging 36 is provided along the patch 10 and in this example, gives the illusion of a torn area within the pair of pants 28. The choice of color of the bottom layer of material 18 is left to the wearer, as is the tattoo design 16 and additional material 32.

The tattoo design 16 may be a permanent addition to the bottom layer 18 or may be removably attached along the periphery 24 to the bottom layer of material 18 by any means such as heat-activated adhesive glue, Velcro, adhesive, heat bonding, zip-on, sewing, or the like. Additionally, the patch 10 may be permanently or removably attached to the article of apparel 12 along its perimeter 40 by any means such as heat-activated adhesive glue, sewing, Velcro, zipper or the like.

The patch 10 may be provided in kit form and include a preselected tattoo design, skin-tone color and additional material. Alternatively, the kit may include various tattoo designs that may be easily removed from the bottom layer in exchange for a new design. Various bottom layer colors and additional material of different colors and fabric may be provide for ready removal and exchange to allow for multiple variations of a simulated tattoo design.

Figure 3:
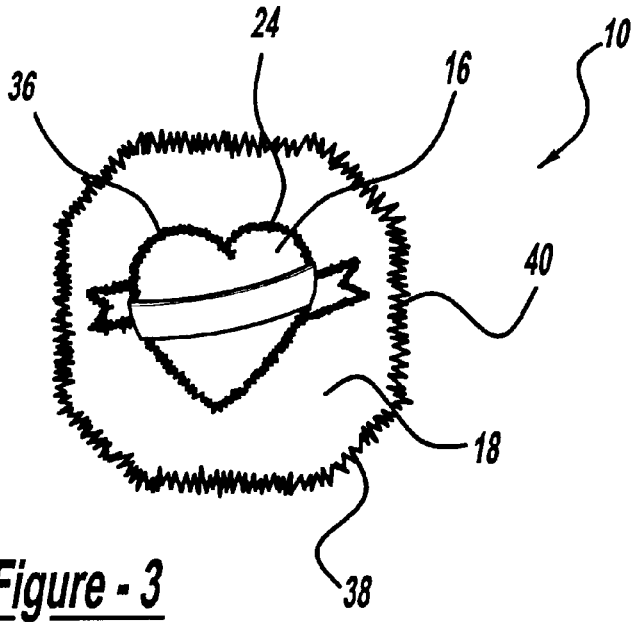
FIGS. 3 and 4 are perspective views illustrating the method for creating the preferred embodiment of the present invention.
Figure 4:
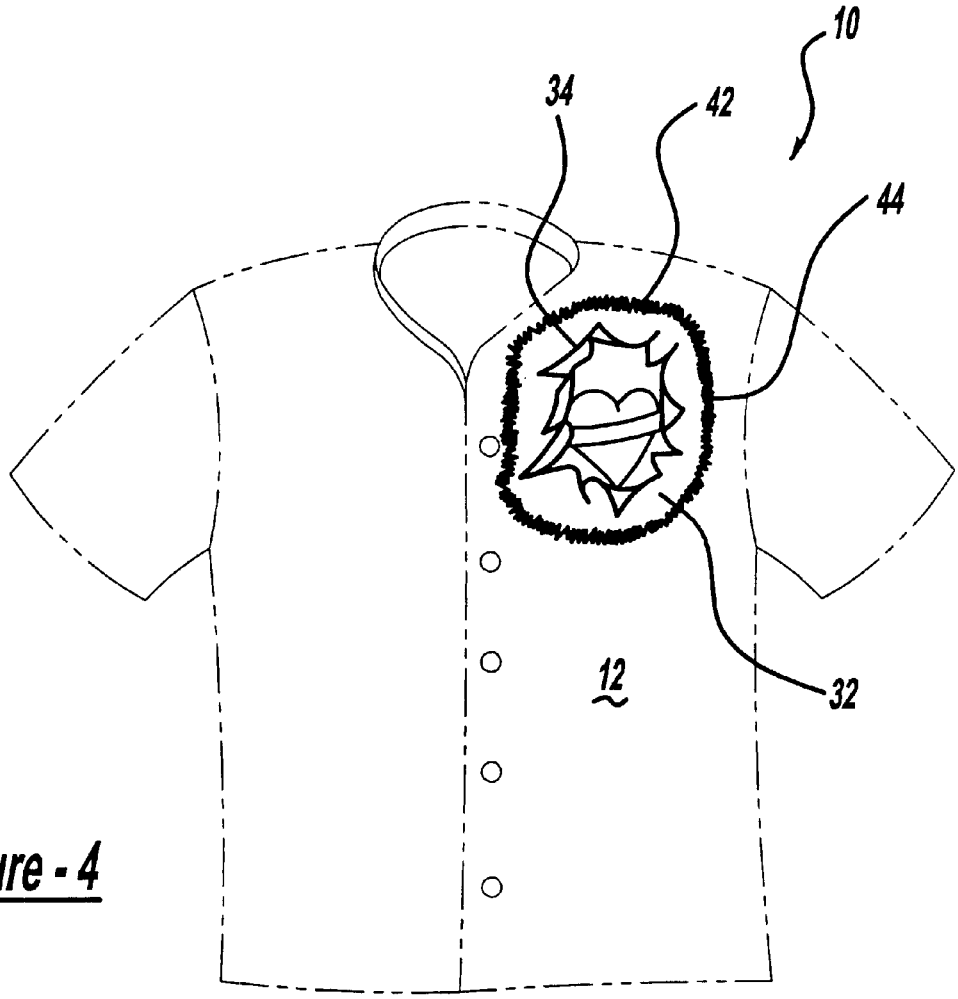

FIGS. 3 and 4 illustrate an article of clothing 12 with the various forms of the simulated tattoo patch and kit of the present invention as described above. In particular, FIG. 3 illustrates the tattoo design 16 shown with a removable fastening edge 36 along its periphery 24. The bottom layer of material 18 is also shown with a removable fastening edge 38 about its perimeter 40. The bottom layer of material 18 may be removable from the article of apparel 12 and the tattoo design 16 may be removable from the bottom layer 18. This allows the wearer to freely choose a tattoo design and the color or design desired for the exposed lower layer of material.

FIG. 4 illustrates the patch 10 with the additional material 32 provided with a torn and fringed edge 34 to give the illusion that the wearer is wearing torn clothing exposing a tattoo on the wearer's skin in the area of the tear. This illusion allows the wearer to choose and interchange a body tattoo and the location of a tear exposing the tattoo without having to expose the wearer's skin or permanently tattooing the wearer's body. The patch 10 with additional material 32 is shown with a removable fastening edge 42 about its perimeter 44.

The type of apparel used in the application may be those illustrated or any other form of clothing that may be worn. The additional material may be any type of material preferably used to make clothing. The location of the tear may be anywhere within the body of the apparel and the size of the exposed area is not limited. The tattoo and bottom layer material may also be formed of any type of material and in any color combination preferred by the wearer.

Additionally, the method of the present invention may be used to form advertising product on an automotive vehicle or other modes of transportation such as a bus, train, subway car, recreational vehicle, boats, jet skis, and snowmobiles using any acceptable method such as adhesive or vinyl graphic technology. Still other methods of application include product packaging for goods such as CD's, DVD's and cases and advertising for billboards, placards, mailings and magazine tear-out postcards.

When used in this form, it is preferable that the patch is formed using vinyl or graphic technology for use and, if necessary, easy adhesion to the product line. The simulated tattoo patch is preferably artistically enhanced to provide an additional material forming the tear area surrounding the simulated tattoo of the present invention. A vehicle, such as an automobile, may be provided with an adhesive patch forming at least a portion of the automobile for advertising purposes. The patch includes a top layer of material having a tattoo design and opposing bottom layer. The bottom layer is preferably a different color than the tattoo design and is preferably the color of a preferred substrate such as a skin tone or automobile paint.

Additional material surrounds the top and bottom layers and includes a torn edge. The torn edge is preferably along the top layer, adjacent the skin-toned bottom layer and simulates a tear within an advertised article of apparel or within the automotive vehicle itself. The patch may also include fringed edging to give the illusion of a torn area within the product. The choice of color of the bottom layer of material is left to the user, as is the tattoo design, additional material and choice of substrate.

The person of skill in the art will recognize that features and aspects of a method and a patch for creating a simulated tattoo on an article of apparel disclosed herein may be used in any combination described as desired, needed or as may be possible.

It should be understood that the invention is not limited to the exact embodiment or construction that has been illustrated and described but that various changes may be made without departing from the spirit and the scope of the invention.

What is claimed is:

1. A patch for creating a simulated tattoo on an article of apparel comprising:

a top layer; and an opposing bottom layer having an outer edge;

said top layer comprising a printed tattoo design; said bottom layer comprising a skin-toned background surrounding said design and forming the basis of said simulated tattoo; and said bottom layer further comprising a fastener for attaching said patch to said article of apparel.

2. The patch as defined in claim 1, wherein said patch is removably fastened to an article of apparel.

3. The patch as defined in claim 1, wherein said patch is permanently fastened to an article of apparel.

4. The patch as defined in claim 2, wherein said removable fastener is a zipper extending along the outer edge of said bottom layer for mating with a zipper provided within an article of apparel at a desired location.

5. The patch as defined in claim 3, wherein said permanent fastener is a heat activated adhesive glue.

6. The patch as defined in claim 1, wherein said tattoo design is removably fastened to said skin-toned background.

7. The patch as defined in claim 1, said patch further comprising material surrounding said top and bottom layers, said material having a torn edge along said top layer and adjacent said skin-toned background simulating a tear within the article of apparel supporting said patch.

8. The patch as defined in claim 7, said surrounding material further comprising a fastener along said bottom layer for attaching said patch to an article of apparel.

9. A kit for creating a simulated tattoo on an article of apparel comprising:

a patch supporting a printed tattoo design; and fastening means for attaching said patch to an article of apparel;

wherein said patch comprises an upper layer having said printed tattoo design surrounded by a lower layer having a skin-toned background, said background forming the basis of said simulated tattoo.

10. The kit as defined in claim 9, wherein said patch is pre-selected from a variety of available tattoo designs fixedly attached to said skin-toned background.

11. The kit as defined in claim 9, wherein said kit further comprises a multiplicity of tattoo designs having fastening means for removably fastening a chosen design to said skin-toned background.

12. The kit as defined in claim 9, wherein said fastening means extends about the periphery of said skin-toned background for attaching said patch to the underside of an article of apparel.

13. The kit as defined in claim 9, said patch further comprising material surrounding said upper layer, said material having a torn edge along said upper layer and adjacent said skin-toned background simulating a tear within the article of apparel supporting said patch.

14. The kit as defined in claim 13, wherein said fastening means extends about the periphery of said material for attaching said patch atop an article of apparel.

15. A method for creating a simulated tattoo on a substrate comprising the steps of:

choosing a printed tattoo design;

fastening said design to a background material, said design and said background material combining to form a simulated tattoo;

attaching said simulated tattoo to said substrate; wherein said background material of said simulated tattoo includes an opening having a fringed outer edge surrounding said printed tattoo design; and exposing said simulated tattoo through said opening.

16. The method as defined in claim 15, wherein said substrate is selected from the group consisting of an article of apparel, an automotive vehicle, a bus, train, subway car, recreational vehicle, boat, jet ski, snowmobile, CD's and case, DVD's and case, advertising billboard, placard, mailings and magazine tear-out postcard.

17. The method as defined in claim 16, wherein said substrate is an article of apparel, further comprising the steps of:

prior to attaching said simulated tattoo, tearing said article of apparel;

forming an opening along said tear; and fringing the perimeter of said tear.

18. The method as defined in claim 17, further comprising the step of:

exposing said simulated tattoo through said opening, wherein said tattoo is attached to the underside of said article of apparel.

19. The method as defined in claim 16, wherein said simulated tattoo further comprises material surrounding said tattoo and having a torn edge adjacent said background material, and further comprising the step of:

simulating a tear within said substrate when said simulated tattoo is attached to said substrate.

20. The method of claim 16, wherein said simulated tattoo is removable and replaceable with a different simulated tattoo for attaching to said article of apparel.

* * * * *